US005240801A

United States Patent [19]

Hayashi et al.

[11] Patent Number: 5,240,801

[45] Date of Patent: Aug. 31, 1993

[54] IMAGE-FORMING MEMBER FOR ELECTROPHOTOGRAPHY AND MANUFACTURING METHOD FOR THE SAME

[75] Inventors: Shigenori Hayashi, Atsugi; Shunpei Yamazaki, Tokyo, both of Japan

[73] Assignee: Semiconductor Energy Laboratory Co., Ltd., Kanagawa, Japan

[21] Appl. No.: 991,519

[22] Filed: Dec. 16, 1992

Related U.S. Application Data

[63] Continuation of Ser. No. 663,177, Mar. 1, 1991, abandoned, which is a continuation-in-part of Ser. No. 615,281, Nov. 19, 1990, abandoned.

[30] Foreign Application Priority Data

| | | | |
|---|---|---|---|
| Nov. 20, 1989 | [JP] | Japan | 1-302398 |
| May 23, 1990 | [JP] | Japan | 2-74923 |
| May 23, 1990 | [JP] | Japan | 2-74924 |
| May 23, 1990 | [JP] | Japan | 2-74925 |
| May 23, 1990 | [JP] | Japan | 2-74926 |

[51] Int. Cl.[5] ..... G03G 5/043; G03G 5/047

[52] U.S. Cl. ..... 430/57; 430/56; 430/58; 430/59; 430/66; 430/67; 430/132

[58] Field of Search ..... 430/66, 67, 132

[56] References Cited

U.S. PATENT DOCUMENTS

| | | | |
|---|---|---|---|
| 4,049,448 | 9/1977 | Honjo et al. | 430/66 X |
| 4,190,445 | 2/1980 | Takahashi et al. | 430/132 X |
| 4,256,823 | 3/1981 | Takahashi et al. | 430/131 X |

FOREIGN PATENT DOCUMENTS

| | | | |
|---|---|---|---|
| 43381 | 12/1979 | Japan | 430/132 |
| 136656 | 8/1982 | Japan | 430/132 |
| 56446 | 3/1989 | Japan | 430/66 |

*Primary Examiner*—Roland Martin

*Attorney, Agent, or Firm*—Sixbey, Friedman, Leedom & Ferguson

[57] ABSTRACT

An image-forming member for electrophotography and a manufacturing method for the same and an electrostatic photocopying machine are disclosed. The image-forming member comprises an organic photoconductive layer formed on a conductive substrate and a protective layer formed on the organic photoconductive layer. Hollows such as pinholes and cracks in the organic photoconductive layer are filled with insulating material, so that the organic photoconductive layer surface becomes even and thereby the protective layer such as a carbonaceous film having high hardness is formed on the organic photoconductive layer with a surface of the protective layer even such that foreign matters can not gather thereon. Alternatively, hollows such as pinholes and cracks in a protective layer are filled with insulating material. Thereby the protective layer surface is made even. Because of evenness and hardness of the protective layer, the image-forming member is immune to wear or scratches, and consequently clear images having no image flow, blur of images, white strips, and voids are obtained on copying sheets with an electrostatic photocopying machine utilizing the image-forming member.

32 Claims, 14 Drawing Sheets

IMAGE-FORMING MEMBER FOR ELECTROPHOTOGRAPHY AND MANUFACTURING METHOD FOR THE SAME

This application is a continuation of Ser. No. 07/663,177, filed Mar. 1, 1991, now abandoned, which itself was a continuation-in-part of Ser. No. 07/615,281, filed Nov. 19, 1990, now abandoned.

BACKGROUND OF THE INVENTION

1. Field of the Invention

The present invention relates to an image-forming member for electrophotography and a manufacturing method for the same.

2. Description of the Prior Art

Generally, as a photoconductor employed for electrophotography are known an inorganic photoconductive material such as selenium dispersed in binder which is provided on a conductive substrate, an organic photoconductive material such as poly-N-vinylcarbazole, trinitrofluorenone, or azo pigment dispersed in binder which is provided on a conductive substrate, an amorphous silicon material dispersed in binder which is provided on a conductive substrate, and the like.

Electrophotographic technology is one of image formation methods. In the electrophotographic technology, a surface of a photoconductor for electrophotography receives in a dark environment electric charges generated by, for example, corona discharge. Then the photoconductor is exposed to light and electric charges only on the portion directed by light rays are selectively neutralized, whereby electrostatic latent image is formed on the photoconductor. The latent image is then developed to a visible image by the selective attraction of electroscopic fine particles (toner) consisting of colorant such as dye or pigment and binder such as macromolecule substances.

Basic properties of a photoconductor required in such a method of electrophotography are:

1) capability of receiving sufficient electric charges in a dark environment;

2) capability of holding the electric charges in a dark environment with little dissipating; and 3) capability of quickly neutralizing the electric charges when the photoconductor receives light rays.

Each of the above photoconductors has other superior properties and drawbacks on the practical use as well as these basic properties, respectively. However, an organic photoconductor has been remarkably developed for a couple of years, since it is manufactured with low cost, and it hardly contaminates the environment, and further it can be designed rather free.

Generally, there are two kinds of organic photoconductors; organic photoconductors of single-layer type and organic photoconductors of lamination type. The organic photoconductor of single-layer type itself functions to generate electric charges and to transport the generated electric charges. On the other hand, the organic photoconductor of lamination type consists of a charge carrier generation layer (CGL) functioning to generate electric charges and a charge carrier transport layer (CTL) functioning to transport the electric charges generated in the charge carrier generation layer. If necessary, an organic photoconductor may be provided with a blocking layer between the organic photoconductor and a conductive substrate in order to prevent electric charges in the conductive substrate from entering the organic photoconductor or to prevent light from being reflected by a conductive substrate provided under the organic photoconductor.

These organic photoconductors have superior properties as mentioned above. However, since such organic photoconductors have low hardness, they are easily worn or scratched by developers, cleaning parts, or the like during copying process.

Due to the wear of the organic photoconductor, electric potential of the organic photoconductor surface is decreased. and the local scratches on photoconductor are copied on a copying sheet. These two drawbacks largely influence a photoconductor's life.

In order to solve these drawbacks, a method of protecting surfaces of organic photoconductors has been proposed. In this method, a protective layer is disposed on the surface, whereby durability of organic photoconductor against mechanical loads which photoconductor receives internally or externally from copying machines has been improved.

Concerning methods to improve durability of organic photoconductors, for instance, a method of providing an organic film on a surface of photoconductor (as described in Japanese Patent Publication No. sho38-15446), a method of providing inorganic oxide (as described in Japanese Patent Publication No. sho43-14517), a method of providing an adhesive layer and subsequently an insulating layer (as described in Japanese Patent Publication No. sho43-27591), a method of providing an a-Si layer, a-Si:N:H layer, a-Si:O:H layer, or the like by means of plasma CVD method or photo CVD method (as described in Japanese Patent Provisional Publication Nos. sho57-179859 and sho59-58437), and the like have been proposed. Further a diamond like carbon film having high hardness have been utilized as a protective layer provided on an organic photoconductor for a couple of years. A protective layer made from amorphous carbon or hard carbon provided on a photoconductive layer (as described in Japanese Patent Provisional Publication No. sho60-249155), a protective layer made from diamond like carbon provided on a photoconductor surface (as described in Japanese Patent Provisional Publication No. sho61-255352), an insulating layer having high hardness containing carbon as a main ingredient provided on a photoconductive layer (as described in Japanese Patent Provisional Publication No. sho61-264355), a protective layer consisting of plasma organic polymer layer containing at least atoms such as nitrogen atoms and alkali metal atoms which is provided on an organic photoconductive layer (as described in Japanese Patent Provisional Publication Nos. sho63-97961 to sho63-97964), a protective layer consisting of amorphous hydrocarbon layer containing at least atoms such as chalcogen atoms, atoms in group III in the Periodic Table, atoms in group IV in the Periodic Table, and atoms in group V in the Periodic Table generated by glow discharge which is provided on an organic photoconductive layer (as described in Japanese Patent Provisional Publication Nos. sho63-220166 to sho63-220169), and the like have been proposed as examples of protective layer.

In every proposition mentioned above, a thin layer having high hardness containing only carbon or carbon as a main ingredient (belonging to a group of so-called i-carbon layer or diamond like carbon layer) is formed on a surface of an organic photoconductive layer by means of ion processing such as sputtering method, plasma CVD method, glow discharge method, and photo CVD method.

By providing the protective layers, hardness of organic photoconductor surfaces was raised. However, such hard surfaces of the protective layers are immune to wear, so that hollows formed on surfaces of protective layers by virtue of hollows such as pinholes or cracks existing on the surfaces of the organic photoconductive layers remain and the surfaces of the formed protective layers do not become even. In such hollows are gathered foreign matters which lower resistance of photoconductor surfaces, whereby image flow is caused.

When resistance of photoconductor surfaces is lowered by the foreign matters, electric charges which the photoconductor surfaces should be charged with before the photoconductors are exposed to light move easily. Hereupon, latent images become blurred and consequently blurred images which seen to be flowing are obtained on a copying sheet. This is called image flow. Foreign matters such as nitrogen oxides generated by corona discharge, phosphorus oxides contained in toner, and the like react on moisture in the air and are ionized. And the ions generated at this moment such as nitric acid ions, sulfate ions, ammonium ions, and hydroxly group ions and protons act as electric charge transport carriers, and due to such carriers resistance of photoconductor surfaces is lowered. The presence of these foreign matters has been known before the propositions of providing hard protective layers on the photoconductor surfaces. However, because soft surfaces of photoconductors wear while developing with toner, transferring, cleaning by means of cleaning blade or squeegee, these foreign matters gathering in hollows are removed together, so that the presence of the foreign matters was not a problem.

However, in the case where a protective layer 33 having a high hardness is provided on the organic photoconductive layer 30, hollows 34 such as pinholes and cracks are formed in the protective layer 33 as shown in FIG. 9 and the hollows 34 are not reduced by abrasion because of the high hardness of the protective layer 33. Therefore, foreign matters such as ions continue to be collected in the hollows 34 and keep resistance of the photoconductor surface small near the hollows 34. Owing to the small resistance, image flow, blur of images, and the like are formed in a copy.

SUMMARY OF THE INVENTION

It is an object of the present invention to provide an image-forming member for electrophotography which does not cause image flow, blur of images, white strips, voids, and the like on a copying sheet.

It is another object of the present invention to provide a method for manufacturing such an image-forming member.

It is a further object of the present invention to provide an electrostatic photocopying machine which does not cause image flow, blur of images, white strips, voids, and the like on a copying sheet.

In order to accomplish these and other objects, an image-forming member for electrophotography is made with its surface even. The image-forming member comprises a conductive substrate, an organic photoconductive layer formed thereon, and a protective layer formed on the organic photoconductive layer.

Before the formation of the protective layer, hollows such as pinholes on cracks formed in the organic photoconductive layer are filled. Thereby an even surface is obtained on the organic photoconductive layer. The formation of the protective layer is carried out on this even surface, so that an even surface is obtained on the protective layer. Alternatively, after the formation of the protective layer, hollows such as pinholes or cracks formed in the protective layer are filled. Thereby an even surface is obtained on the protective layer.

Anyway, ions, protons, and the like do not gather on such an even surface of the protective layer, and consequently resistance of the surface of the image-forming member is not lowered and therefore electric charges maintained on the surface of the image-forming member do not move. Therefore, image flow, blur of images, white strips, voids, and the like are not caused.

An insulating material may be used for filling the hollows.

The conductive substrate may be a conductor, a insulator subjected to conductive treatment, or an insulator coated with a conductive layer.

The organic photoconductive layer may be an organic photoconductive layer of single-layer type or an organic photoconductive layer of lamination type. The organic photoconductive layer of single-layer type may be an uniform photoconductive layer such as a photoconductive layer of pigment sensitization type and a photoconductive layer of charge-transfer complex sensitization type or an ununiform photoconductive layer which contains a charge carrier transport material and in which particles of charge carrier generation material are dispersed.

The organic photoconductive layer of single-layer type itself functions to generate electric charges and to transport electric charges. The organic photoconductive layer of lamination type consists of a charge carrier generation layer (CGL) functioning to generate electric charges for latent image during exposure and a charge carrier transport layer (CTL) functioning to transport the electric charges generated by the charge carrier generation layer. If necessary, the image-forming member may be provided with a blocking layer functioning to prevent electric charges in the substrate from entering the organic photoconductive layer or to prevent light from being reflected by the substrate.

A protective layer is formed on an organic photoconductive layer in order to raise the hardness of the image-forming member surface and to prevent electric potential on the image-forming member surface from decreasing. Since the surface of the protective layer is even as described above, foreign matters such as ions and protons do not gather on the surface, so that resistance of the image-forming member surface can be prevented from being lowered.

DETAILED DESCRIPTION OF THE PREFERRED EMBODIMENTS

Figure 1A:
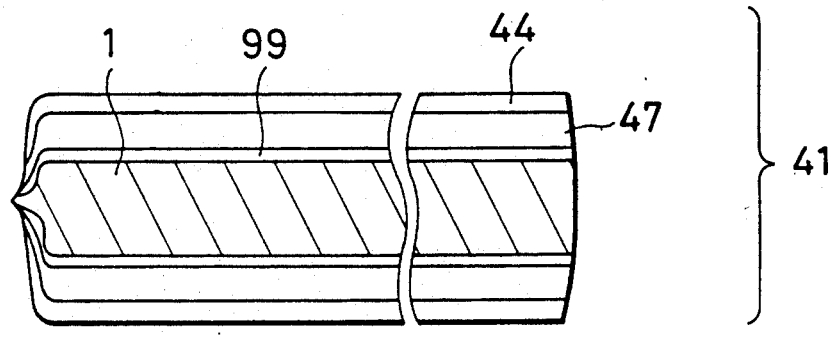
FIG. 1(A) is a cross sectional view schematically showing an image-forming member in accordance with the present invention.
Figure 1B:
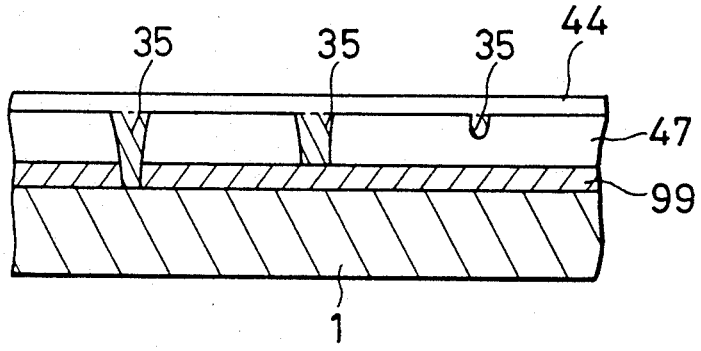
FIG. 1(B) is a partial enlarged view of the image-forming member illustrated in FIG. 1(A).
Figure 1C:
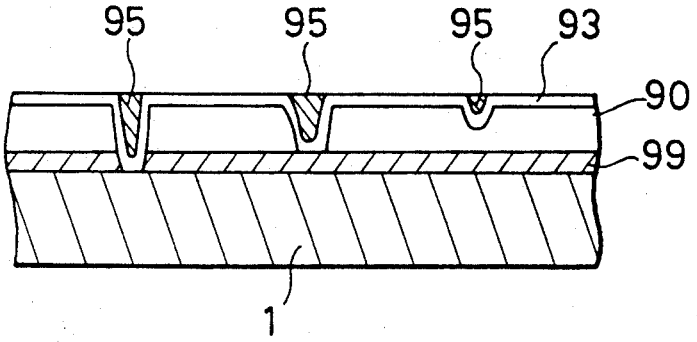
FIG. 1(C) is a cross sectional view showing an image-forming member in accordance with the present invention.
Figure 1D:
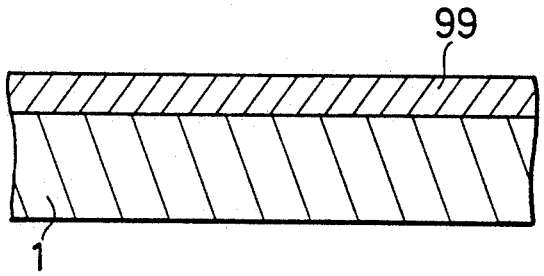
FIGS. 1(D) to (H) are cross sectional views showing steps for forming an image-forming member in accordance with the present invention.
Figure 1E:
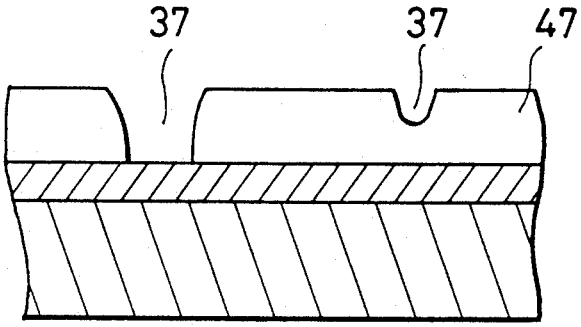
Figure 1F:
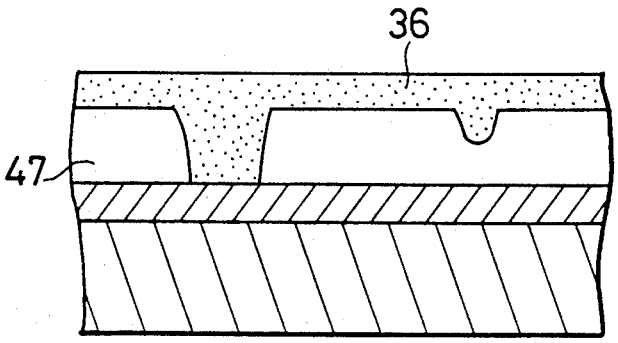
Figure 1G:
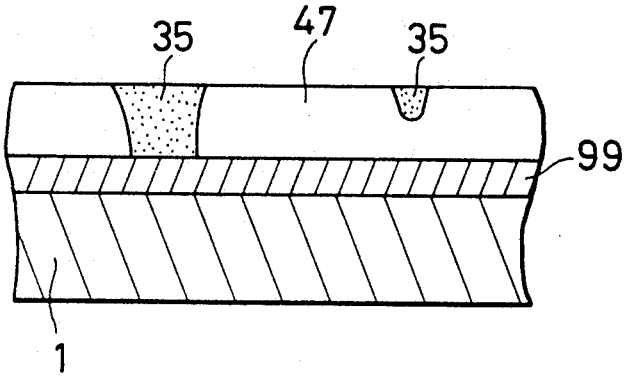
Figure 1H:
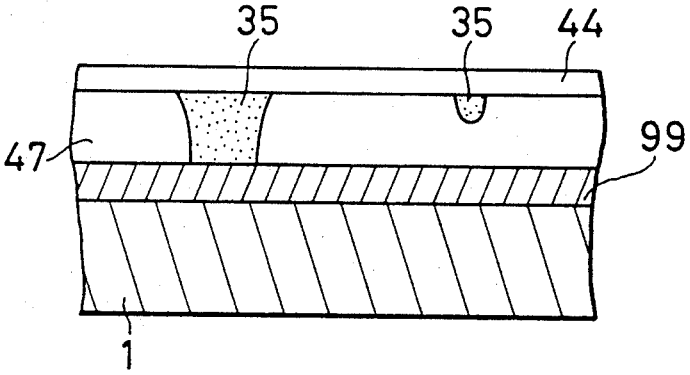
Figure 7:
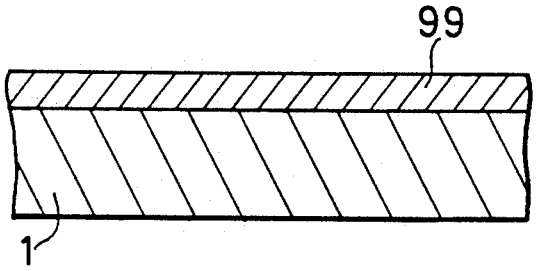
FIGS. 7(A) to (E) are cross sectional views showing steps for forming an image-forming member in accordance with the present invention.
Figure 7:
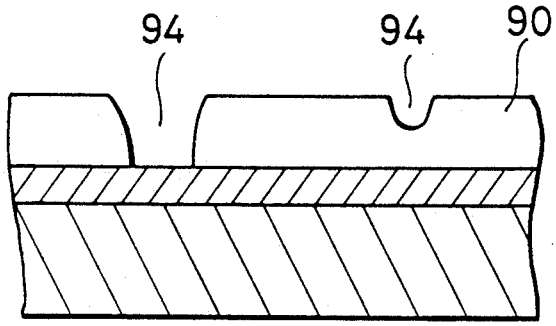
Figure 7:
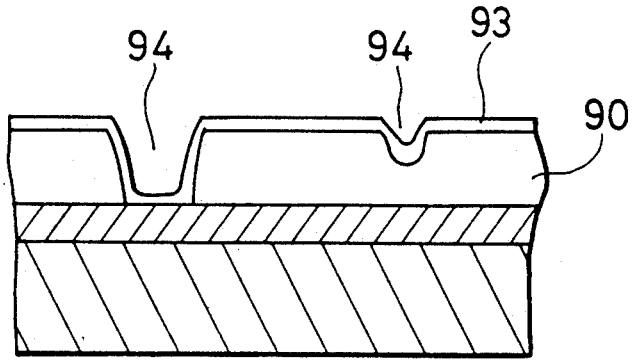
Figure 7:
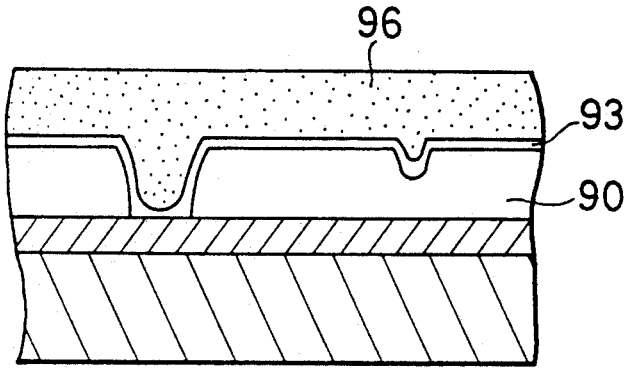
Figure 7:
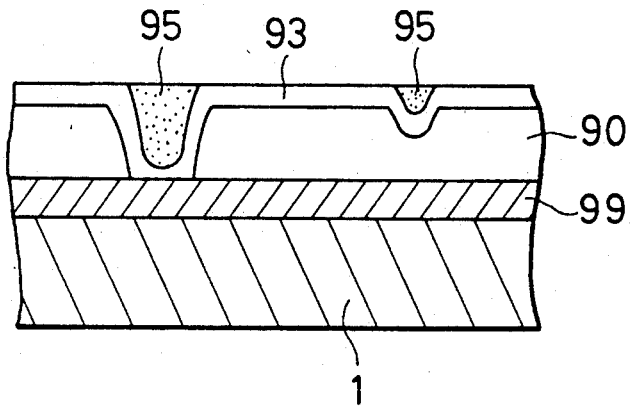

As shown in FIG. 1(A), an image-forming member 41 for electrophotography according to embodiments in the present invention comprises a cylindrical conductive substrate 1, an organic photoconductive layer 47 provided on the cylindrical conductive substrate 1, and a protective layer 44 provided on the organic photoconductive layer 47. A blocking layer 99 may be provided between the substrate 1 and the organic photoconductive layer 47 in order to prevent electric charges in the substrate 1 from entering the organic photoconductive layer 47 or to prevent light from being reflected by the substrate 1. Hollows 37 such as pinholes and cracks in the organic photoconductive layer 47 and the blocking layer 99 are filled with an insulating material 35 as shown in FIG. 1(G) and FIG. 1(B). In FIG. 1(H), the protective layer 44 is directly contacted with the organic photoconductive layer 47. However, a protective layer may be provided on an even surface of a layer which is formed on the organic photoconductive layer 47 and simultaneously extends into the hollows 37. This even surface may be formed by forming a layer on the organic photoconductive layer 47 and subsequently removing an upper portion thereof. Alternatively, hollows 94 such as pinholes and cracks in the protective layer 93 are filled with an insulating material 95 as shown in FIG. 7(E) and FIG. 1(C) instead of filling the hollows 37 in the organic photoconductive layer 47. The layer 96 shown in FIG. 7(D) may be left. That is, a step of removing the layer 96 may be dispensed with. An upper portion of the layer 96 may be removed to obtain an even surface. The insulating materials 35 and 95 have a high fluidity. Therefore, the hollows 37 and 94 can be filled with the insulating materials 35 and 95, respectively. As the insulating materials 35 and 95 may be used organic resins used for the charge carrier generation layer or the charge carrier transport layer of the present invention, an epoxy resin, and a photoresist used in manufacture of a semiconductor device. The insulating material 95 is preferably a material which does not erode the organic photoconductive layer 90. The organic photoconductive layer 90 is not eroded even if pinholes and cracks are formed in the protective layer 93 and the organic photoconductive layer 90 contacts with such a material through some of the pinholes and cracks.

The conductive substrate does not necessarily have a cylindrical shape, but it may have a board shape, a drum shape, a belt shape, or the like.

The conductive substrate used in embodiments in the present invention may be a conductive substrate made from metal such as Al, Ni, Fe, Cu, or Au, or made from alloy of the above metals. Also, a conductive substrate which is composed of an insulating substrate such as polyester, polycarbonate, polyimide, or glass and a coating made from metal such as Al, Ag, or Au or conductive material such as $In_2O_3$ or $SnO_2$ provided on the insulating substrate may be used. Further, papers or the like subjected to conductive treatment may be used as a conductive substrate.

As an organic photoconductive layer can be used an organic photoconductive layer of single-layer type or an organic photoconductive layer of lamination type to be described hereinafter. Between the organic photoconductive layer and the conductive substrate 1 may be provided a blocking layer mentioned above.

The organic photoconductive layer of single-layer type is formed by applying on an underlying layer thereof photoconductive fine particles such as zinc oxide, titanium oxide, or zinc sulfide, selenium fine particles, amorphous silicon fine particles, phthalocyanine pigment, azulenium salt pigment, azo pigment, or the like all of which are sensitized by pigments, together with adhesive resin and/or electron donative compound if necessary. Also, an organic photoconductive layer made from eutectic complex consisting of pyrylium dye and bisphenol A polycarbonate to which electron donative compound is added can be used. The adhesive resin used in the organic photoconductive layer of single-layer type can be the same as in an organic photoconductive layer of lamination type to be described hereinafter. Appropriate thickness of the organic photoconductive layer of single-layer type is 5 to 30 $\mu$m.

On the other hand, an organic photoconductive layer of lamination type is a multilayer consisting of a charge carrier generation layer and a charge carrier transport layer.

For the charge carrier generation layer, a mixture of adhesive resin and charge carrier generation substances dispersed or dissolved in a solvent is used. The charge carrier generation substances are inorganic photoconductive fine particles or organic dye or pigment.

The inorganic photoconductive fine particles are, for example, crystalline selenium or arsenic selenide.

The organic dye or pigment used in the charge carrier generation layer is selected, for example, from the group consisting of CI Pigment Blue 25 (21180 in Color Index (CI)), CI Pigment Red 41 (CI 21200), CI Acid Red 52 (CI 45100), CI Basic Red 3 (CI 45210), azulenium salt pigment, an azo pigment (as described in Japanese Patent Provisional Publication No. sho53-95033) having carbazole structure, an azo pigment (as described in Japanese Patent Provisional Publication No. sho53-138229) having styrylstilbene structure, an azo pigment (as described in Japanese Patent Provisional Publication No. sho53-132547) having triphenylamine structure, an azo pigment (as described in Japanese Patent Provisional Publication No. sho54-21728) having dibenzothiophine structure, an azo pigment (as described in Japanese Patent Provisional Publication No. sho54-12742) having oxadiazole structure, an azo pigment (as described in Japanese Patent Provisional Publication No. sho54-22834) having fluorenone structure, an azo pigment (as described in Japanese Patent Provisional Publication No. sho54-17733) having bisstilbene structure, an azo pigment (as described in Japanese Patent Provisional Publication No. sho54-2129) having distyryloxadiazole structure, an azo pigment (as described in Japanese Patent Provisional Publication No. sho54-2129) having distyrylcarbazole structure, an azo pigment (as described in Japanese Patent Provisional Publication No. sho54-17734) having distyrylcarbazole structure, a triazo pigment (as described in Japanese Patent Provisional Publication No. sho57-195767 and No. sho57-195768) having carbazole structure, a phthalocyanine pigment such as CI Pigment Blue 16 (CI 74100) and the like, an indigo pigment such as CI Vat Brown 5 (CI 73410) and CI Vat Dye 9 (CI 73030) and the like, a perylene pigment such as Argo Scarlet B (manufactured by Vanolet Co.) and Induslene Scarlet R (manufactured by Bayer Co.) and the like.

These charge carrier generation substances are used alone or in combination.

In the case of using an organic dye or pigment as the charge carrier generation substances, the charge carrier generation substances are dispersed or dissolved in adhesive resin in weight ratio (adhesive resin/charge carrier generation substances) of 0 to 1.0, preferably 0 to 0.5.

As adhesive resin which can be used together with these organic pigments are used condensation resin such as polyimide, polyurethane, polyester, epoxy resin, polycarbonate, polyether, and the like and adhesive and insulating resin of polymer or copolymer such as polystyrene, polyacrylate, polymethacrylete, poly-N-vinylcarbazole, polyvinyl butyral, styrene-butadiene copolymer, styrene-acrylonitrile copolymer and the like.

The charge carrier generation layer is formed by dispersing the charge carrier generation substances, together with the adhesive resin if necessary, in a solvent such as tetrahydrofuran, cyclohexane, dioxane, and dichloroethane by the use of a ball mill, an atliter, or a sand mill followed by diluting the dispersion and applying it on a conductive substrate. The application may be done by means of immersing method, spray coating method, bead coating method, or the like.

Appropriate thickness of the charge carrier generation layer is about 0.01 to 5 μm, preferably 0.1 to 2 μm.

In the case of using inorganic photoconductive fine particles such as crystalline selenium or arsenic selenide alloy as the charge carrier generation substances, they are used together with an electron donative substances such as electron donative binding agent and/or electron donative organic compound. The electron donative substance is, for example, nitrogen compounds and diallylmethane compounds such as polyvinylcarbazole and its derivative (which comprises, for example, carbazole structure and a substituent such as a halogen of chlorine and bromine and the like, methyl group, amino group, and the like), polyvinylpyrene, oxadiazole, pyrazoline, hydrazone, diallylmethane, α-phenylstilbene, and triphenylamine compound. Particularly, polylvinylcarbazole and its derivative are preferred. The electron donative substance may be used alone or in combination. In the case of using the electron donative substance in combination, it is preferred that to polyvinylcarbazole and/or its derivative other electron donative organic compound is added.

It is preferred that content of the inorganic photoconductive fine particles used as the charge carrier generation substances is 30 to 90 volume % of the charge carrier generation layer. Moreover, it is preferred that the thickness of the charge carrier generation layer made of the inorganic photoconductive fine particles is 0.2 to 5 μm.

A charge carrier transport layer (CTL) functions to transport electric charges generated in the charge carrier generation layer during exposure. The electric charges transported by the charge carrier transport layer combine with electric charges generated by means of corona discharge and maintained on an image-forming member surface. Resistivity of the charge carrier transport layer is $10^6$ to $10^{14}$ Ω·cm, preferably $10^8$ to $10^{12}$ Ω·cm. The charge carrier transport layer is made of charge carrier transport substances and, if necessary, binder resin. The charge carrier transport layer can be formed by dispersing or dissolving the charge carrier transport substances, together with binder resins if necessary, in a suitable solvent followed by applying the solution on an underlying layer thereof and drying it.

These binder resins are thermoplastic resins or thermosetting resins such as polystyrene, styrene-acrylonitrile copolymer, styrene-butadien copolymer, sytrene-maleic anhydride copolymer, polyester, polyvinylchloride, vinyl chloride-vinyl acetate copolymer, polyvinyl acetate, polyvinylidene chloride, polyacrylate resin, phenoxy resin, polycarbonate, cellulose acetate resin, ethyl cellulose resin, polyvinylbutyral, polyvinylformal, polyvinyl toluene, poly-N-vinylcarbazole, acrylic resin, silicone resin, epoxy resin, melamine resin, urethane resin, phenol resin, and alkyd resin.

There are two kinds of charge carrier transport substances; hole transport substances and electron transport substances.

The hole transport substances are electron donative substances such as poly-N-vinylcarbazole and its derivative, poly-γ-carbazolyethylglutamate and its derivative, pyreneformaldehyde condensate and its derivative, polyvinylpyrene, polyvinylphenanthrene, oxazole derivative, oxadiazole derivative, imidazole derivative, triphenylamine derivative, 9-(p-diethylaminostyryl)anthracene, 1,1-bith-(4-dibenzylaminophenyl) propane, styrylanthracene, styrylpyrazoline, phenylhydrazone group, α-phenylstilbene derivative, and the like.

The electron transport substances are electron acceptable substances such as chloranil, bromanil, tetracyanoethylene, tetracyanoquinonedimethane, 2,4,7-trinitro-9-fluorenone, 2,4,5,7-tetranitro-9-fluorenone, 2,4,5,7-tetranitroxanthrone, 2,4,8-trinitrothioxanthone, 2,6,8-trinitro-4H-indene[1,2-b]thiophene-4-on, and 1,3,7-trinitrodibenzothiophenone-5,5-dioxide.

These charge carrier transport substances are used alone or in combination.

As the solvents in which the charge carrier transport substances are dissolved or dispersed, are used tetrahydrofuran, dioxane, toluene, monochlorobenzene, dichloroethane, methylene chloride, and the like.

Appropriate thickness of the charge carrier transport layer is about 5 to 100 μm. To the charge carrier transport layer may be added plasticizer and leveling agent. Plasticizers such as dibutyl phthalate and dioctyl phthalate which are used as plasticizers for resins in general can be used as the plasticizer to be added to the charge carrier transport layer. The appropriate amount of the plasticizer is 0 to 30 volume % of the binder resin. Silicone oil group such as dimethyl silicone oil and methyl phenyl silicone oil is used as the leveling agent, and the appropriate amount of the leveling agent is 0 to 1 volume % of the binder resin.

These two layers, a charge carrier generation layer and a charge carrier transport layer, may be laminated on a conductive substrate in this order. Alternatively, they may be laminated in the inverse order.

The way of forming a protective layer will be described hereinafter.

Figure 2:
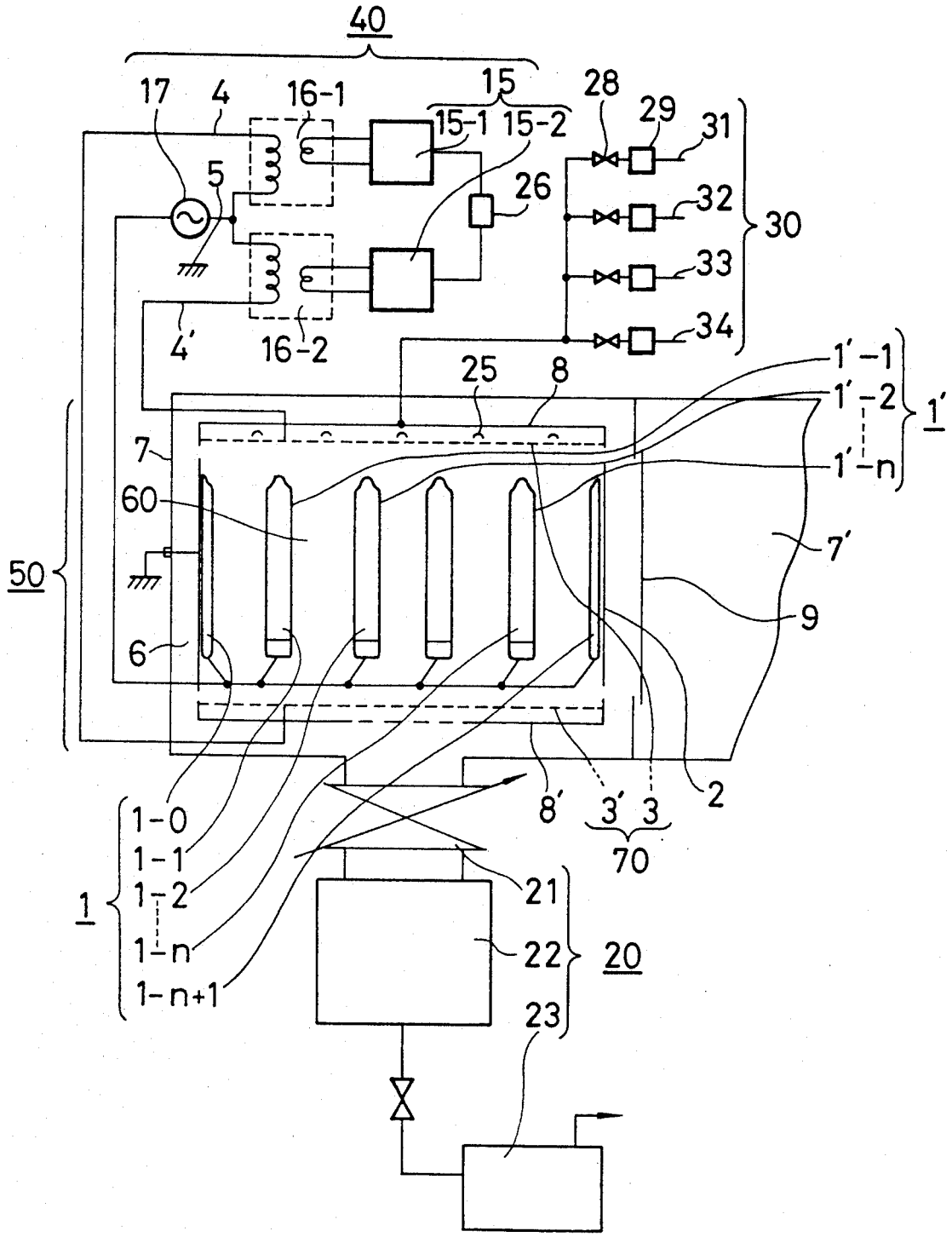
FIG. 2 is a schematic view showing a plasma CVD apparatus used in the present invention.

In FIG. 2 is illustrated an example of apparatus which can be used in the present invention. As shown in FIG. 2, a reaction vessel 7 and a preliminary chamber 7' for load/unload in a plasma CVD apparatus are partitioned by a gate valve 9 disposed therebetween. Carrier gas from 31, reactive gas from 32, additive gas from 33, and etchant gas for etching inside walls of the reaction vessel from 34 in a gas introduction system 30 are introduced into a reaction system 50 via a valve 28 and a flowmeter 29 through nozzles 25.

Figure 3A:
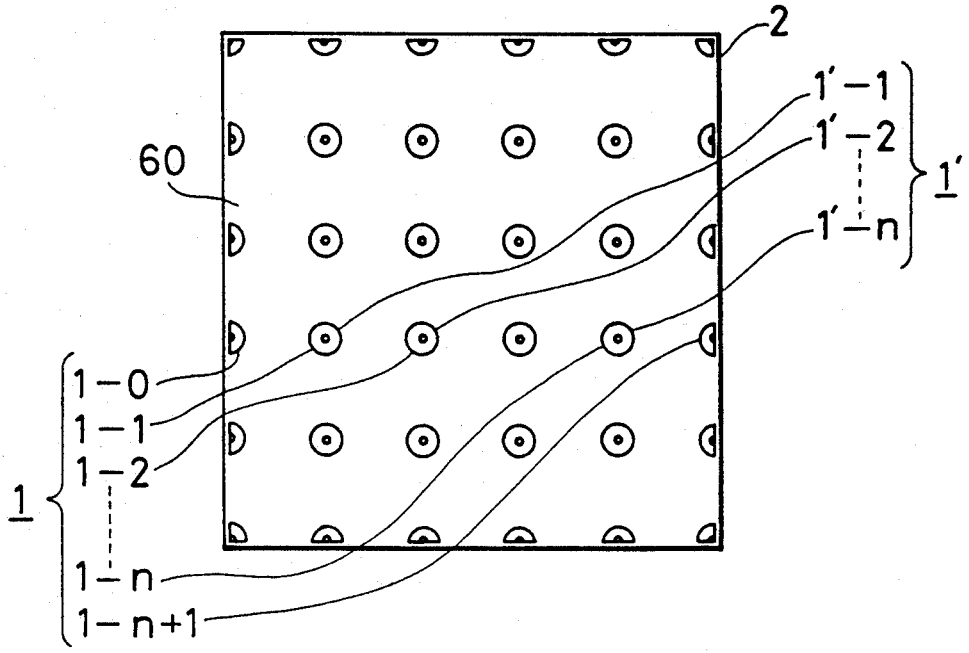
FIGS. 3(A) and (B) show examples of arrangement of substrates in the plasma CVD apparatus shown in FIG. 2, respectively.
Figure 3B:
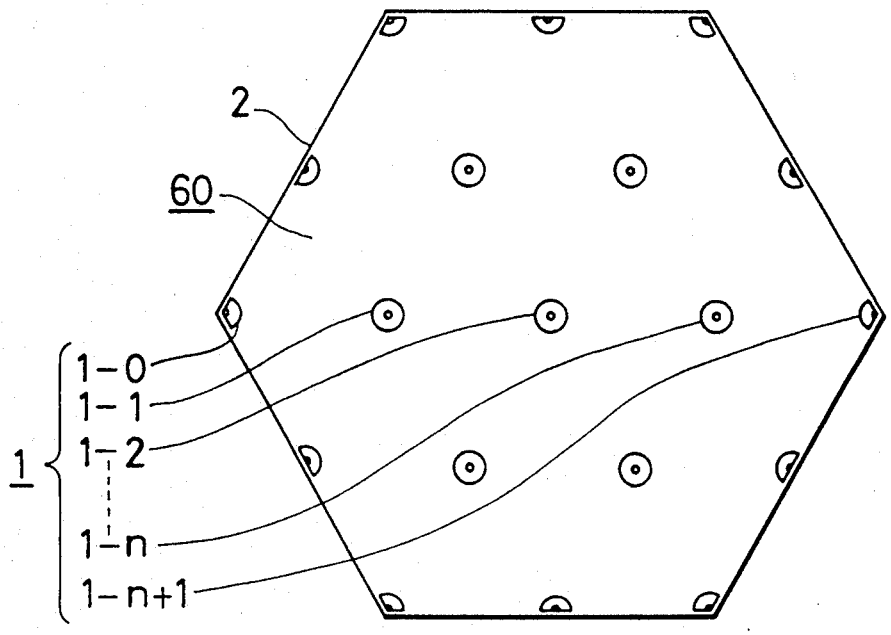

The reaction system 50 has a frame structure 2 (which is a square or a hexagonal frame structure when seen from electrode sides as shown in FIGS. 3(A) and (B)), and hoods 8 and 8' are disposed to cover openings situated on upper side and lower side of the frame structure 2. A pair of mesh electrodes 3 and 3', namely a first electrode and a second electrode, made from aluminum having an identical form is disposed adjacent to the hoods 8 and 8' respectively. The reactive gas is released to an under direction from the nozzles 25. Cylindrical substrates 1 are made from aluminum and provided with organic photoconductive layers thereon. The cylindrical substrates function as third electrodes. In the case of applying a DC voltage which means voltage having sufficiently low frequency, the photoconductive layer acts as an insulator for the DC voltage. However, in the case of applying a second AC voltage which means voltage having sufficiently high frequency, the photoconductive layer acts as a conductor for the second AC voltage and bias is applied to the photoconductive layer. Film formation surfaces 1' of the substrates 1 are disposed in plasma generated by the pair of mesh electrodes 3 and 3'. The substrates 1-1, 1-2, . . . , 1-n, i.e., 1 have film formation surfaces 1'-1, 1'-2, . . . , 1'-n, i.e., 1', respectively, and the second AC voltage is applied to the substrates at a frequency of 1 to 500 KHz. In addition to the second AC voltage, a negative DC bias is applied thereto. The DC bias may be self bias which is caused by the plasma itself and is caused owing to the structure of the plasma reaction apparatus. Alternatively, the DC bias may be DC bias which is applied by a DC power source. Reactive gas converted into plasma (glow discharge) by a first high frequency was dispersed uniformly in a reaction space 60. The plasma was confined within the frame structure 2 and the hoods 8 and 8', and was prevented from reaching an outer space 6 and no film was deposited on inside walls of the reaction vessel. Besides potential of the plasma in the reaction space was made uniform.

Further, in order to make more uniform distribution of potential in the plasma reaction space, in a power source system 40, two kinds of AC voltages having different frequencies from each other are to be applied. A first AC voltage having a high frequency of 1 to 100 MHz reaches matching transformers 16-1 and 16-2 from a pair of power sources 15-1 and 15-2. Phases of the respective voltages in the matching transformers are adjusted by means of phase adjustor 26 so that the voltages can be supplied through respective matching transformers with the respective phases different by an angle of 180° or 0°. The matching transformers have outputs of symmetrical type or in-phase type, and one output end 4 and the other output end 4' of the transformers are connected to the first electrode 3' and the second electrode 3, respectively. A midpoint 5 of the output side of the transformers is grounded, and a second AC electric field 17 is applied thereto at a frequency of 1 to 500 KHz. The output via the midpoint 5 is connected to the substrates 1-1', 1-2', . . . , 1-n', i.e., 1 or the holder 2 electrically connected to these substrates, namely, it is connected to a third electrode, through a condenser (omitted in the drawing).

Thus, plasma is generated in the reaction space 60. Unnecessary gases are exhausted through a pressure control valve 21, a turbo molecular pump 22, and a rotary pump 23 in an evacuation system 20.

Figure 4:
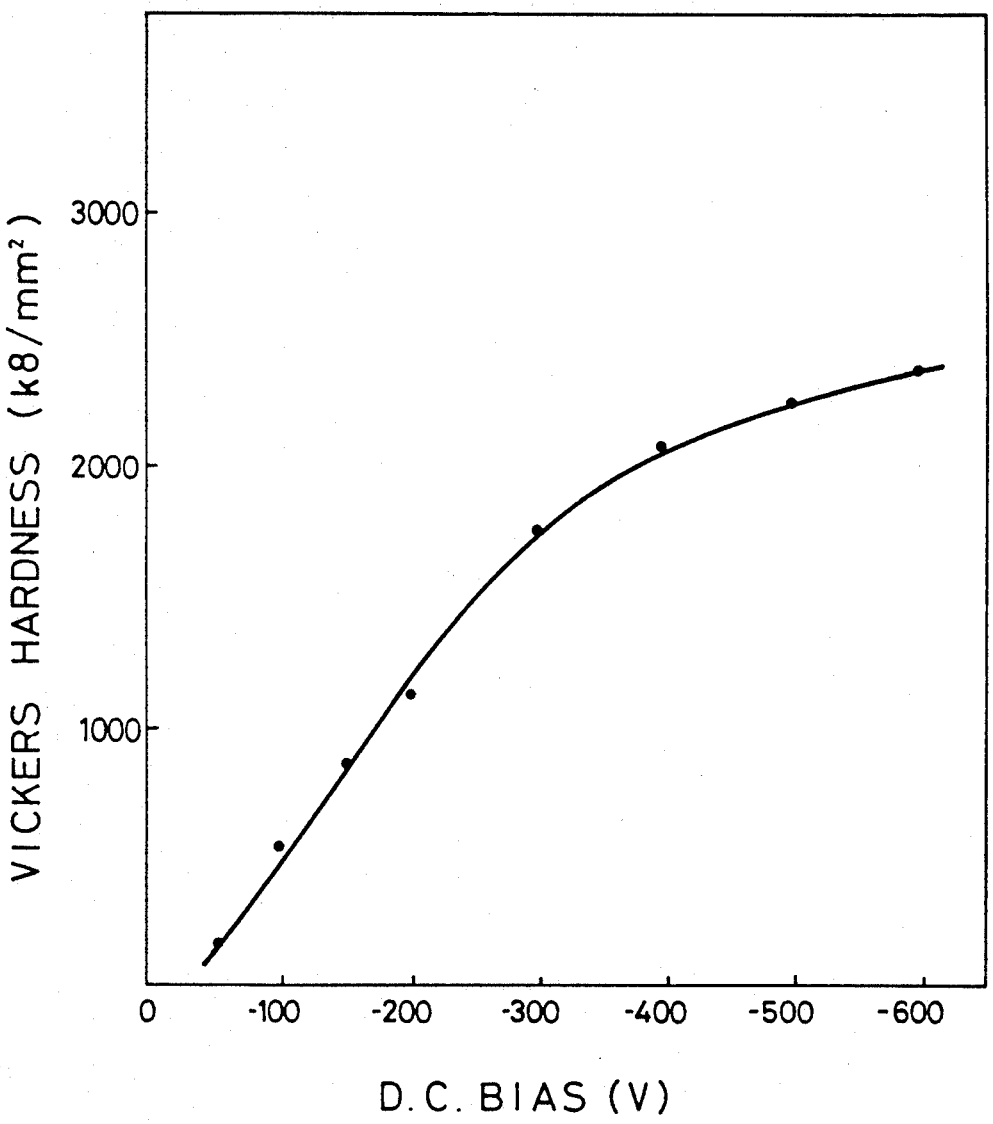
FIG. 4 shows a relation between a negative self-bias voltage and hardness of a protective layer.

A pressure of the reactive gas was 0.001 to 1.0 torr in the reaction space 60. The frame structure 2 has a square or hexagonal shape, and in the case of square shape as shown in FIG. 3(A), the frame structure 2 has a width of 75 cm, a length of 75 cm, and a height of 50 cm. And in this frame structure cylindrical substrates 1-1, 1-2, . . . , 1-n, e.g. sixteen cylindrical substrates having film formation surfaces thereon are disposed with regular interval. Inside the frame structure 2 surrounding the cylindrical substrates, dummy substrates 1-0 and 1-n+1 are also disposed with the same regular interval as the above in order to form an uniform electric field in the frame structure 2. To such a reaction space is applied a first AC voltage having a high frequency of 1 to 100 MHz at 0.5 to 5 KW (0.3 to 3 W/cm$^2$). Further, by application of a second AC bias voltage, a negative self bias voltage of −10 to −600 V is applied to the film formation surfaces. By virtue of this negative self bias voltage, reactive gas introduced into the reaction space is accelerated and sputters the substrates, whereby dense films as protective layers can be formed on the cylindrical substrates. Hardness of the films can be controlled by regulating the negative self bias voltage. In FIG. 4 is shown a relation between a negative self bias voltage and film hardness in the case of forming a carbonaceous film as a protective layer. Usually, as absolute value of negative self bias is larger, the carbonaceous protective film is formed harder, as shown in FIG. 4.

When forming as a protective layer a carbonaceous film (including carbon film, diamond like carbon film, and diamond like carbon film to which additive is added) whose main ingredient is carbon, hydrogen or argon can be used as carrier gas, hydrocarbon gas such as methane and ethylene or carbide gas such as carbon fluoride as reactive gas, and nitride gas such as nitrogen fluoride and ammonia as additive gas. As etching gas for etching inside walls of the reaction vessel, oxygen or fluoride gas such as nitrogen fluoride and carbon fluoride can be used. In the case of introducing ethylene and nitrogen fluoride as reactive gas, a diamond like carbon film to which nitrogen and fluorine are added can be formed.

Reactive gas used in the present invention is, for example, a gas mixture of ethylene and nitrogen fluoride, in which the ratio of $NF_3$ to $C_2H_4$ is 1/20 to 4/1. With the variation of this ratio, transmissivity and resistivity can be controlled.

Typically, the substrates are maintained at room temperature.

The carbonaceous film formed in the above manner has C—C bonds of diamond having $SP^3$ orbit, a Vickers hardness of 100 to 3000 $Kg/mm^2$, and a resistivity of $1\times10^7$ to $1\times10^{15}\Omega cm$. Further, the above film has a property similar to that of diamond and transmits light in infrared region or visible region and has optical energy band gap (referred to as Eg) of 1.0 eV or more, preferably 1.5 to 5.5 eV.

The thickness of the carbonaceous film used as a protective layer according to the present invention is preferably 0.1 to 5 μm, more preferably 0.2 to 1 μm, and the resistivity of the film is preferably $10^8$ to $10^{13}\Omega cm$, more preferably $10^9$ to $10^{12}\Omega cm$.

A multi-layer comprising carbonaceous films according to the present invention may be used as the protective layer of the present invention. Alternatively, as the protective layer a silicon nitride film may be formed by the use of the plasma CVD apparatus shown in FIG. 2.

Not only the above protective layers such as carbonaceous film and silicon nitride film but also other films such as silicon oxide film and silicon carbide film can be used as the protective layer in the present invention. In the case of forming a silicon nitride film or a silicon carbide film as a protective layer, it is preferred that the ratio between silicon and nitrogen or the ratio between silicon and carbon is controlled to obtain a protective layer having resistivity of $10^6$ to $10^{14}\Omega cm$, further preferably $10^8$ to $10^{12}\Omega cm$. In the case of silicon oxide film as a protective layer, PSG (phosphosilicate glass) which is obtained by introducing phosphorus during the silicon oxide film formation and has resistivity of $10^6$ to $10^{14}\Omega cm$, preferably $10^8$ to $10^{12}\Omega cm$, is preferable. However, such protective layers except for carbon film or film containing mainly carbon might cause a problem on adhesivity to organic photoconductive layers provided under the protective layers. In order to enhance the adhesivity between protective layer and photoconductive layer, conditions for forming protective layer are selected in accordance with the kind of protective layer to be formed. Also, a protective multi-layer comprising layers made of different materials may be formed, whereby the adhesivity can be enhanced.

As an insulating material for filling hollows such as pinholes and cracks in a photoconductive layer or a protective layer is preferred a material having high fluidity in order to fill easily fine hollows therewith.

For example, hollows are filled with an alcohol solution in which organic silicon oxide is dissolved or a solution in which photoresist, polyimide, polyvinylpyrolidone, or polyvinylalcohol is dissolved. Subsequently the alcohol or a solvent of this solution is removed. Alternatively, the above-mentioned materials used for organic photoconductive layers may be used as the material filling the hollows.

Embodiment No. 1

This embodiment shows an example of forming on a cylindrical substrate 1 shown in FIG. 1(A) an organic photoconductive layer 47 and on the organic photoconductive layer 47 a carbonaceous film 44.

FIG. 1(A) is a cross sectional view showing an image-forming member for electrophotography. FIG. 1(B) is a partial enlarged view of FIG. 1(A).

$TiO_2$ (manufactured by Ishihara Industrial Co., Ltd. and called Taipek), polyamide resin (manufactured by Toray Co., Ltd. and called CM-8000), and methyl alcohol were provided in a ball mill at a weight ratio $TiO_2$:polyamide resin:methyl alcohol=1:1:25. They were dispersed for 12 hours in a ball mill. Subsequently the dispersed mixture was applied on a surface of a cylindrical substrate 1 made from aluminum having a diameter of 40 mm and a length of 250 mm by immersing method. The mixture was dried and thereby a blocking layer 99 of about 2 μm thickness was obtained on the substrate 1 as shown in FIG. 1(D).

On the blocking layer 99 formed on the external surface of the cylindrical substrate 1, a charge carrier generation layer of about 0.15 μm thickness was formed in the following manner. Polyester resin (manufactured by Toyobo Co., Ltd. and called Byron) and cyclohexane and a triazo pigment represented by the following formula were provided in a ball mill. They were dispersed for 72 hours in the ball mill.

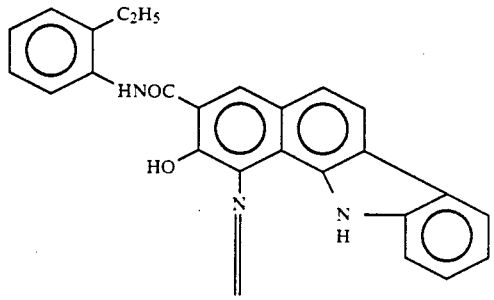

-continued

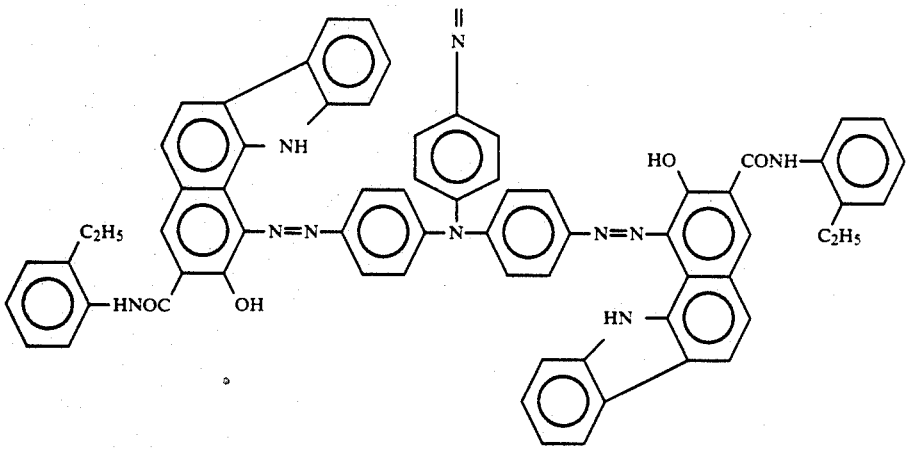

The dispersion was further diluted by a mixture of the same amounts of cyclohexane and methylethylketone. The weight ratio of the polyester resin:the cyclohexane:the triazo pigment:the mixture of cyclohexane and methylethylketone was 12:360:30:500. The diluted solution was applied on the blocking layer 99 by immersing method and dried at a temperature of 120° C. for ten minutes.

Then, a charge carrier transport layer was formed on the charge carrier generation layer formed on the cylindrical substrate 1 in the following manner. Polycarbonate (called C1400 as trade name and manufactured by Teijin Kasei Co., Ltd.), silicone oil (called KF50 as trade name and manufactured by Shinetsu Silicone Co., Ltd.), tetrahydrofuran, and a compound A represented by the following formula were mixed at a weight ratio of polycarbonate:silicone oil:tetrahydrofuran:compound A = 10:0.0002:80:10.

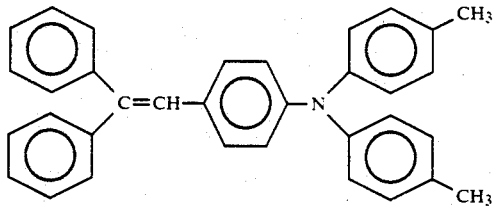

The mixture was applied on the charge carrier generation layer by immersing method and dried. As a result, a charge carrier transport layer having a thickness of about 20 μm is formed. In FIG. 1(E), reference numeral 47 designates a photoconductive layer comprising the charge carrier generation layer and the charge carrier transport layer. Hollows 37 such as pinholes, cracks and the like are formed in the photoconductive layer 47 as shown in FIG. 1(E). The hollows are caused by dusts during the formation of the organic photoconductive layer, scratches on the substrate, uneven surface of underlying layer 99 provided under the organic photoconductive layer 47, and cracks formed in the organic photoconductive layer 47.

Figure 5:
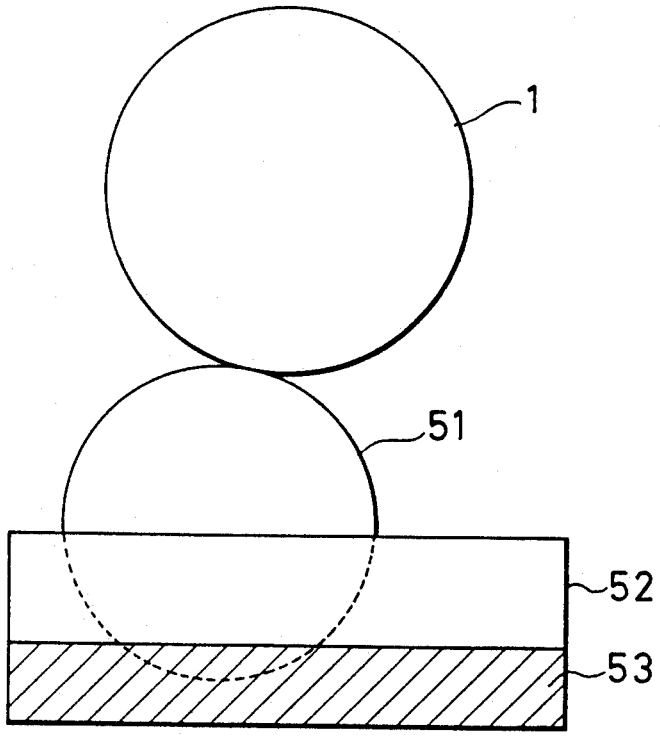
FIG. 5 is a view showing the way of using a roller which is used in manufacture of an image-forming member for electrophotography in accordance with the present invention.

Then, hollows 37 such as pinholes and cracks in the organic photoconductive layer 47 were filled with an insulating material 36 by means of roll coating method as shown in FIG. 5.

In this embodiment, photoresist of positive type having viscosity of 50 CP or less was used as the insulating material 36. Since hollows 37 such as pinholes and cracks are small, it is difficult to fill such small hollows 37 with photoresist having viscosity of more than 50 CP and such a process takes much time. Therefore, the photoresist having viscosity of 50 CP or less was preferred. In this embodiment, photoresist having viscosity of 5 CP was used.

The photoresist 53 was provided in a solution storage 52 as shown in FIG. 5. A coating roller 51 was rolled at 100 revolutions per minute in the photoresist in order that the photoresist was maintained on the coating roller surface when the coating roller 51 was taken out from the solution storage 52. Then the coating roller 51 coated with the photoresist was pressed against the photoconductive layer formed on the cylindrical substrate 1 and was rolled twice to ten times on the photoconductive layer at the same time to thereby form a photoresist layer 36 on the entire surface of the photoconductive layer 47 as shown in FIG. 1(F). The photoresist was prebaked at a temperature of 50° C. for ten minutes and subsequently radiated with ultraviolet ray having a wave length of about 400 nm for three seconds. Then, by developing, the photoresist except for the photoresist filling hollows was removed.

The radiation of the ultraviolet ray was performed for three seconds as mentioned above, because, if the photoresist is excessively radiated with the ultraviolet ray, the ray reaches the photoresist in the hollows and consequently such photoresist in the hollows which should not be removed is also removed during developing.

Then the photoresist filling hollows was again baked at a temperature of 75° C. for 30 minutes, whereby an organic photoconductive layer having an even surface was completed as shown in FIG. 1(G).

Then the organic photoconductive layer was subjected to hydrogen plasma processing in order to remove oxygen such as $O_2$ and $H_2O$ adhering to the surface of the organic photoconductive layer. $H_2$ was introduced into the reaction vessel at 50 SCCM and then hydrogen plasma was generated by applying a first AC electric field at a frequency of 13.56 MHz, and a second AC electric field at a frequency of 50 kHz was applied. Consequently DC bias component was −100 V in the reaction vessel.

After this, a carbonaceous film as a protective layer was formed in the same manner as mentioned hereinbefore. The apparatus illustrated in FIG. 2 was used for carbonaceous film formation. $NF_3$ was introduced into the reaction vessel at 5 SCCM, and $C_2H_4$ at 80 SCCM. The pressure in the reaction vessel was 0.05 Torr. The frequency and the output of a first AC electric field were chosen to be 13.56 MHz and 400 W. The frequency of a second AC electric field, the voltage of the second AC electric field, and a DC bias were chosen to be 250 KHz, 100 V, and −50 V, respectively. A carbonaceous film 44 was deposited on the organic photoconductive layer 47 to 0.8 μm thick at a deposition rate of 500 Å/min. The resistivity of the deposited carbonaceous film was measured to be $1\times10^{13}$ Ωcm. The film 44 had an amorphous or crystalline structure and transmitted infrared or visible light. The Vickers hardness of the carbonaceous film 44 was measured to be 1500 $Kg/mm^2$, and the optical energy band gap thereof was measured to be 2.4 eV.

Thus, a carbonaceous film 44 whose main ingredient is carbon, particularly a carbonaceous film containing hydrogen at 30 atom % or less, fluorine at 0.3 to 3 atom %, and nitrogen at 0.3 to 10 atom %, could be deposited as a protective layer on an organic photoconductive layer 47. By the above process, a wear resistant image-forming member for electrophotography could be completed whose surface is even so that foreign matters generated during corona discharge and the like are unable to adhere thereto.

Embodiment No. 2

In this embodiment is shown a case that the same material as that used for the charge carrier transport layer in Embodiment No. 1 is used as a material for filling hollows in an organic photoconductive layer.

An organic photoconductive layer 47 was formed on a drum for electrostatic copying in the same manner as in Embodiment No. 1. Then the mixture same as that used for the charge carrier transport layer was applied on the organic photoconductive layer by immersing method and subjected to thermal treatment. A solvent in the mixture was removed by the thermal treatment and consequently an organic film 36 was formed on the surface of the organic photoconductive layer as shown in FIG. 1(F). Then by making use of squeegee or the like the organic film formed on the surface of the organic photoconductive layer was removed except for the organic material filling hollows 37. Thereby the hollows 37 such as pinholes or cracks in the organic photoconductive layer were filled with the organic material which was the same as that used for the charge carrier transport layer, and the surface of the organic photoconductive layer was made even. Subsequently, a carbonaceous film 44 was deposited as a protective layer on the even surface of the organic photoconductive layer in the same manner as in Embodiment No. 1, whereby an image-forming member for electrophotography was completed.

Embodiment No. 3

In this embodiment is shown a case that the same material as that used for the charge carrier transport layer in Embodiment No. 1 is used as a material for filling hollows in an organic photoconductive layer.

Figure 8:
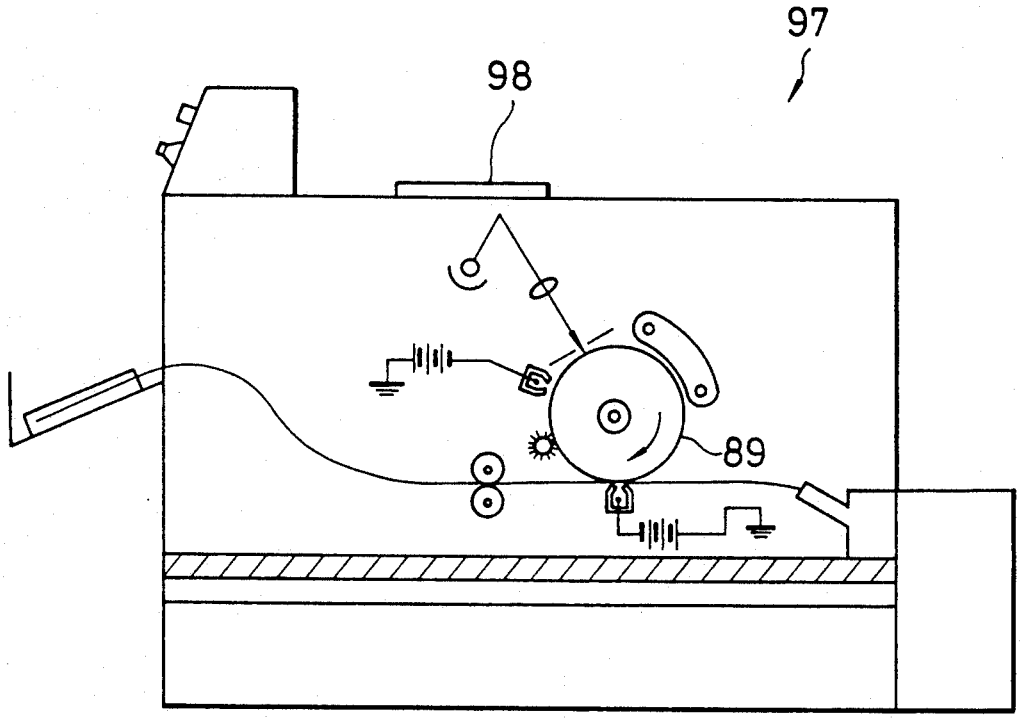
FIG. 8 is a schematic view showing an electrostatic photocopying machine in accordance with the present invention.
Figure 9:
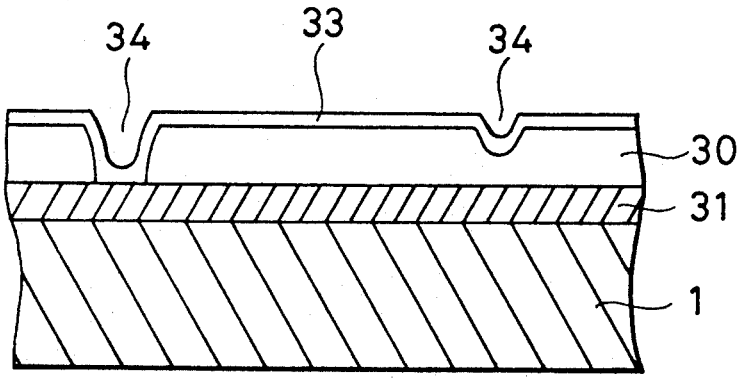
FIG. 9 is a cross sectional view showing a conventional image-forming member for electrophotography.

An organic photoconductor 89 was completed by forming an organic photoconductive layer 47 on a drum for electrostatic copying in the same manner as in Embodiment No. 1. Then the organic photoconductor 89 was practically disposed in an electrostatic photocopying machine 97 shown in FIG. 8 and electrophotography process was carried out 1000 to 150000 times with the machine 97. After this, the organic photoconductor 89 was taken out from the machine 97 and the surface of the photoconductive layer 47 was cleaned in order to remove therefrom substances adhering to the photoconductive layer 47 which lower surface resistance. Subsequently, in the same manner as in Embodiment No. 2, hollows 37 on the cleaned surface of the organic photoconductive layer 47 were filled with the material 35 same as that used for the charge carrier transport layer, and then a carbonaceous film 44 was deposited as a protective layer on the even organic photoconductive layer surface, whereby an image-forming member for electrophotography was completed.

In this embodiment, the organic photoconductor was practically disposed in an electrostatic photocopying machine during electrophotography process and subsequently cracks generated during the practical electrophotography process as well as hollows before the process were filled with the material. So that, cracks were not generated any more after the above filling process. Therefore, white strips and voids were not generated on a copying sheet by the later electrophotography process.

For reference, an image-forming member for electrophotography was produced in the same manner as in Embodiment No. 1except that hollows on an organic photoconductive layer thereof were not filled. Both of the image-forming member in accordance with the present invention and the referential image-forming member were respectively disposed in identical electrostatic photocopying machine 97. With respect to the both image-forming members, electrophotography process was carried out 1000 times with the machine 97 and subsequently the image-forming members were charged throughout one hour. These processes were repeated five times. Then copies obtained by copying the same manuscript 98 by the use of the respective image-forming members were compared with each other.

As a result, in the case of the image-forming member in accordance with the present invention, white strips and voids were not generated. On the contrary, white strips and voids were generated in the case of the referential image-forming member.

Then, surface resistances of the both image-forming members were measured, respectively. Surface resistance of the image-forming member in accordance with the present invention hardly varied from its initial surface resistance. Ratio of change (calculated by dividing the initial resistance by the measured resistance) in the case of the image-forming member in accordance with the present invention was in the range of 1.2 to 2.5. On the contrary, ratio of change in the case of the referential image-forming member was in the range of 50 to 1000, that is, the surface resistance was varied largely.

Embodiment No. 4

This embodiment shows an example of forming on a cylindrical substrate 1 an organic photoconductive layer 90 and on the organic photoconductive layer 90 a carbonaceous film 93.

FIG. 1(C) is a partial cross sectional view showing an image-forming member for electrophotography comprising a cylindrical substrate 1, a blocking layer 99 provided thereon, an organic photoconductive layer 90 provided on the blocking layer 99, and a protective layer 93 provided on the organic photoconductive layer 90.

$TiO_2$ (manufactured by Ishihara Industrial Co., Ltd. and called Taipek), polyamide resin (manufactured by Toray Co., Ltd. and called CM-8000), and methyl alcohol were provided in a ball mill at a weight ratio $TiO_2$:polyamide resin:methyl alcohol = 1:1:25. They were dispersed for 12 hours in a ball mill. Subsequently the dispersed mixture was applied on a surface of cylindrical substrate 1 made from aluminum having a diameter of 40 mm and a length of 250 mm by immersing method. The mixture was dried and thereby a blocking layer 99 of about 2 μm thickness was obtained on the substrate 1 as shown in FIG. 7(A).

On the blocking layer 99 formed on the external surface of the cylindrical substrate 1, a charge carrier generation layer of about 0.15 μm thickness was formed in the following manner. Polyester resin (manufactured by Toyobo Co., Ltd. and called Byron) and cyclohexane and a triazo pigment represented by the following formula were provided in a ball mill. They were dispersed for 72 hours in a ball mill.

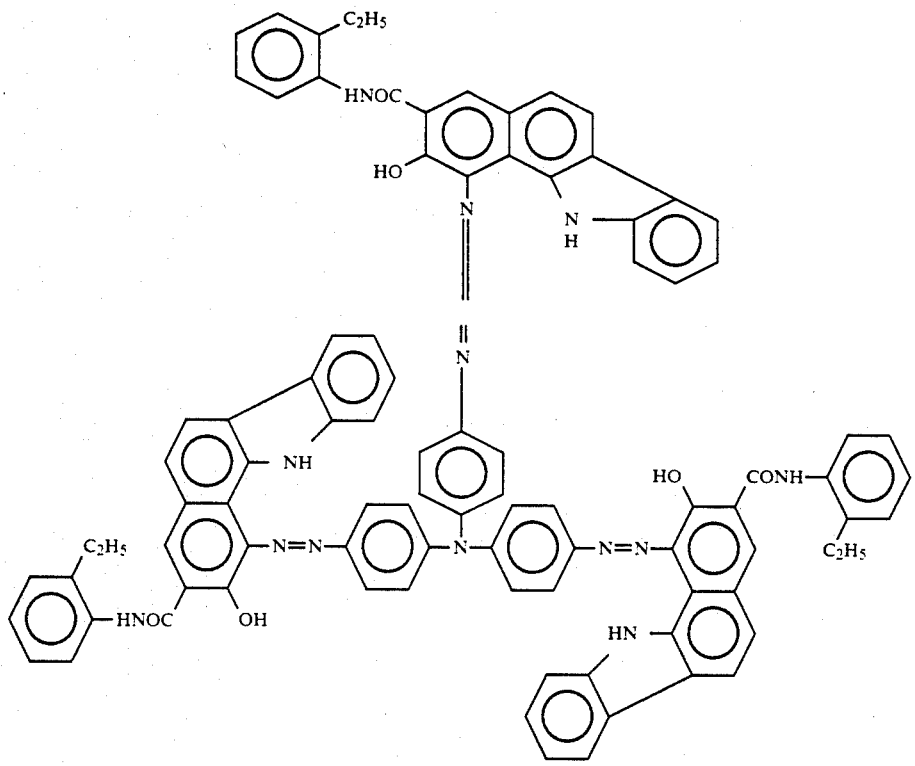

The dispersion was further diluted by a mixture of the same amounts of cyclohexane and methylethylketone. The weight ratio of the polyester resin:the cyclohexane:the triazo pigment:the mixture of cyclohexane and methylethylketone was 12:360:30:500. The diluted solution was applied on the blocking layer 99 by immersing method and dried at a temperature of 120° C. for ten minutes.

Then, a charge carrier transport layer was formed on the charge carrier generation layer formed on the cylindrical substrate in the following manner. Polycarbonate (called C1400 as trade name and manufactured by Teijin Kasei Co., Ltd.), silicone oil (called KF50 as trade name and manufactured by Shinetsu Silicone Co., Ltd.), tetrahydrofuran, and a compound A represented by the following formula were mixed at a weight ratio of polycarbonate:silicone oil:tetrahydrofuran:compound A = 10:0.0002:80:10.

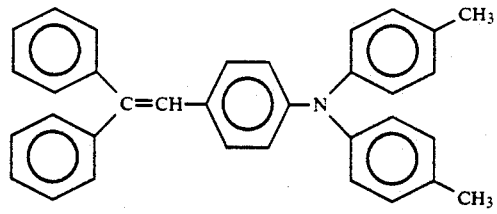

The mixture was applied on the charge carrier generation layer by immersing method and dried. As a result, a charge carrier transport layer having a thickness of about 20 μm was formed and hollows 94 such as pinholes, cracks, and the like were formed in an organic photoconductive layer 90 consisting of the charge carrier generation layer and the charge carrier transport layer as shown in FIG. 7(B). The hollows are caused by dusts during the formation of the organic photoconductive layer 90, scratches on the substrate, an uneven surface of underlying layer provided under the organic photoconductive layer 90, and cracks formed in the organic photoconductive layer 90.

Hydrogen plasma processing was effected on a surface of the organic photoconductive layer 90 at a $H_2$ flow rate of 50 SCCM under application of a bias voltage having a D.C. component of −100 V applied by a second AC electric field (50 KHz) in plasma generated by a first AC electric field (13.56 MHz) in order to remove oxygen, for example in $O_2$ and $H_2O$, adhering to the surface.

After this, a carbonaceous film as a protective layer was formed in the same manner as mentioned hereinbefore. The apparatus illustrated in FIG. 2 was used for carbonaceous film formation. $NF_3$ was introduced into the reaction vessel at 5SCCM, and $C_2H_4$ at 80SCCM. The pressure in the reaction vessel was 0.05 Torr. The frequency and the output of a first AC electric field were chosen to be 13.56 MHz and 400 W. The frequency of a second AC electric field, the voltage of the second AC electric field, and a DC bias were chosen to be 250 KHz, 100 V, and −50 V, respectively. A carbonaceous film 93 was deposited to 0.8 μm thick at a deposition rate of 500 Å/min. The resistivity of the deposited carbonaceous film was measured to be $1\times10^{13}\Omega$ cm. The film had an amorphous or crystalline structure and transmitted infrared or visible light. The Vickers hardness of the carbonaceous film was measured to be 1500 $Kg/mm^2$, and the optical energy band gap was measured to be 2.4 eV.

Thus, a carbonaceous film 93 whose main ingredient is carbon, particularly a carbonaceous film containing hydrogen at 30 atom % or less, fluorine at 0.3 to 3 atom %, and nitrogen at 0.3 to 10 atom %, could be deposited as a protective layer on an organic photoconductive layer 90 as illustrated in FIG. 7(C). Proportion of oxygen atoms at the interface between the photoconductive layer 90 and the carbonaceous film 93 was 1 atom % or less.

Then, hollows 94 such as pinholes or cracks in the protective layer 93 (carbonaceous film 93) were filled with an insulating material 96 by means of roll coating apparatus as Then, hollows 94 such as pinholes or cracks in the protective layer 93 (carbonaceous film 93) were filled with an insulating material 96 by means of roll coating apparatus as shown in FIG. 5.

In this embodiment, photoresist of positive type having viscosity of 50 CP or less was used as the insulating material 96. Since hollows such as pinholes and cracks are small, it is difficult to fill such small hollows with photoresist having viscosity of more than 50 CP and such a process takes much time. Therefore, the photoresist having viscosity of 50 CP or less was preferred. In this embodiment, photoresist having viscosity of 5 CP was used.

The photoresist 53 was provided in a solution storage 52 as shown in FIG. 5. A coating roller 51 was rolled at 100 revolutions per minute in the photoresist 53 in order that the photoresist was maintained on the coating roller surface when the coating roller 51 was taken out from the solution storage 52. Then the coating roller coated with the photoresist was pressed against the protective layer 93 formed on the cylindrical substrate 1 and was rolled twice to ten times on the protective layer 93 at the same time to thereby fill the hollows 94 with the photoresist and form a photoresist layer 96 on the entire surface of the carbonaceous film 93 as illustrated in FIG. 7(D). The photoresist was prebaked at a temperature of 50° C. for ten minutes and subsequently radiated with ultraviolet ray having a wave length of about 400 nm for three seconds. Then, by developing, the photoresist except for the photoresist filling the hollows 94 was removed. Thereby an even surface was obtained on the carbonaceous film 93 as illustrated in FIG. 7(E).

The radiation of the ultraviolet ray was performed for three seconds as mentioned above, because, if the photoresist is excessively radiated with the ultraviolet ray, the ray reaches the photoresist in the hollows and consequently such photoresist in the hollows which should not be removed is also removed during developing.

Then the photoresist filling hollows was again baked at a temperature of 75° C. for 30 minutes, whereby an image-forming member for electrophotography having an even surface as illustrated in FIG. 7(E) was completed.

Embodiment No. 5

In this embodiment is shown a case that the same material as that used for the charge carrier transport layer in Embodiment No. 4 is used as a material for filling hollows in a protective layer.

An organic photoconductive layer 90 was formed on a drum 1 for electrostatic copying in the same manner as in Embodiment No. 4. Then a carbonaceous film 93 was deposited as a protective layer on the organic photoconductive layer 90 in the same manner as in Embodiment No. 4. Then the mixture same as that used for the charge carrier transport layer was applied on the carbonaceous film 93 by immersing method and subjected to thermal treatment. A solvent in the mixture was removed by the thermal treatment and consequently an organic film 96 was formed on the surface of the carbonaceous film 93. Then by making use of squeegee or the like the organic film 96 formed on the surface of the carbonaceous film 93 was removed except for the organic material filling hollows 94. Thereby the hollows 94 such as pinholes or cracks in the carbonaceous film 93 were filled with the organic material which was the same as that used for the charge carrier transport layer, and the surface of the carbonaceous film 93 was made even.

Embodiment No. 6

In this embodiment is shown a case that the same material as that used for the charge carrier transport layer in Embodiment No. 4 is used as a material for filling hollows in a carbonaceous film.

An organic photoconductive 89 was completed by forming an organic photoconductive layer 90 on a drum 1 for electrostatic copying and forming a protective layer 93 on the organic photoconductive layer 90 in the same manner as in Embodiment No. 4. Then the organic photoconductor 89 was practically disposed in an electrostatic photocopying machine 97 shown in FIG. 8 and electrophotography process was carried out 1000 to 150000 times with the machine 97. After this, the organic photoconductor 89 was taken out from the machine 97 and the surface of the carbonaceous film 93 was cleaned in order to remove therefrom substances adhering to the carbonaceous film surface which lower surface resistance. Subsequently, in the same manner as in Embodiment No. 5, hollows on the cleaned surface of the carbonaceous film 93 were filled with the material same as that used for the charge carrier transport layer, whereby an image-forming member for electrophotography having an even surface was completed.

In this embodiment, the organic photoconductor 89 was practically disposed in an electrostatic photocopying machine 97 during electrophotography process and subsequently cracks generated during the practical electrophotography process as well as hollows before the process were filled with the material. So that, cracks were not generated any more after the above filling process. Therefore, white strips and voids were not produced on a copying sheet by the later electrophotography process.

For reference, an image-forming member for electrophotography was produced in the same manner as in Embodiment No. 4 except that hollows on the carbonaceous film were not filled. Both of the image-forming member in accordance with the present invention and the referential image-forming member were respectively disposed in identical electrostatic photocopying machine 97. With respect to the both image-forming members, electrophotography process was carried out 1000 times with the machine 97 and subsequently the image-forming members were charged throughout one hour. These processes were repeated five times. Then copies obtained by copying the same manuscript 98 by the use of the respective image-forming members were compared with each other.

As a result, in the case of the image-forming member in accordance with the present invention, white strips and voids were not generated. On the contrary, white strips and voids were generated in the case of the referential image-forming member.

Then, surface resistances of the both image-forming members were measured, respectively. Surface resistance of the image-forming member in accordance with the present invention hardly varied from its initial surface resistance. Ratio of change (calculated by dividing the initial resistance by the measured resistance) in the case of the image-forming member in accordance with the present invention was in the range of 1.2 to 2.5. On the contrary, ratio of change in the case of the referential image-forming member was in the range of 50 to 1000, that is, the surface resistance was varied largely.

Embodiment No. 7

In this embodiment is shown an example of an electrostatic photocopying machine utilizing the above mentioned image-forming member. The image-forming member used in this embodiment has a drum shape.

Figure 6:
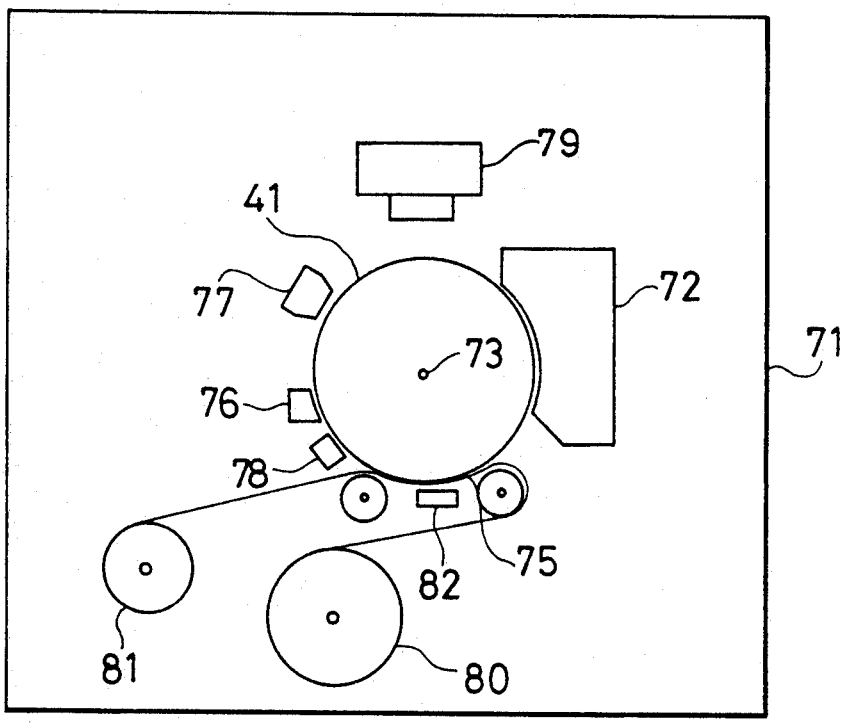
FIG. 6(A) shows an outline of an electrostatic photocopying machine in accordance with the present invention.
FIG. 6(B) is a partial enlarged view of FIG. 6(A).

FIG. 6(A) is a schematic view showing the electrostatic photocopying machine 71 used in this embodiment.

Figure 6B:
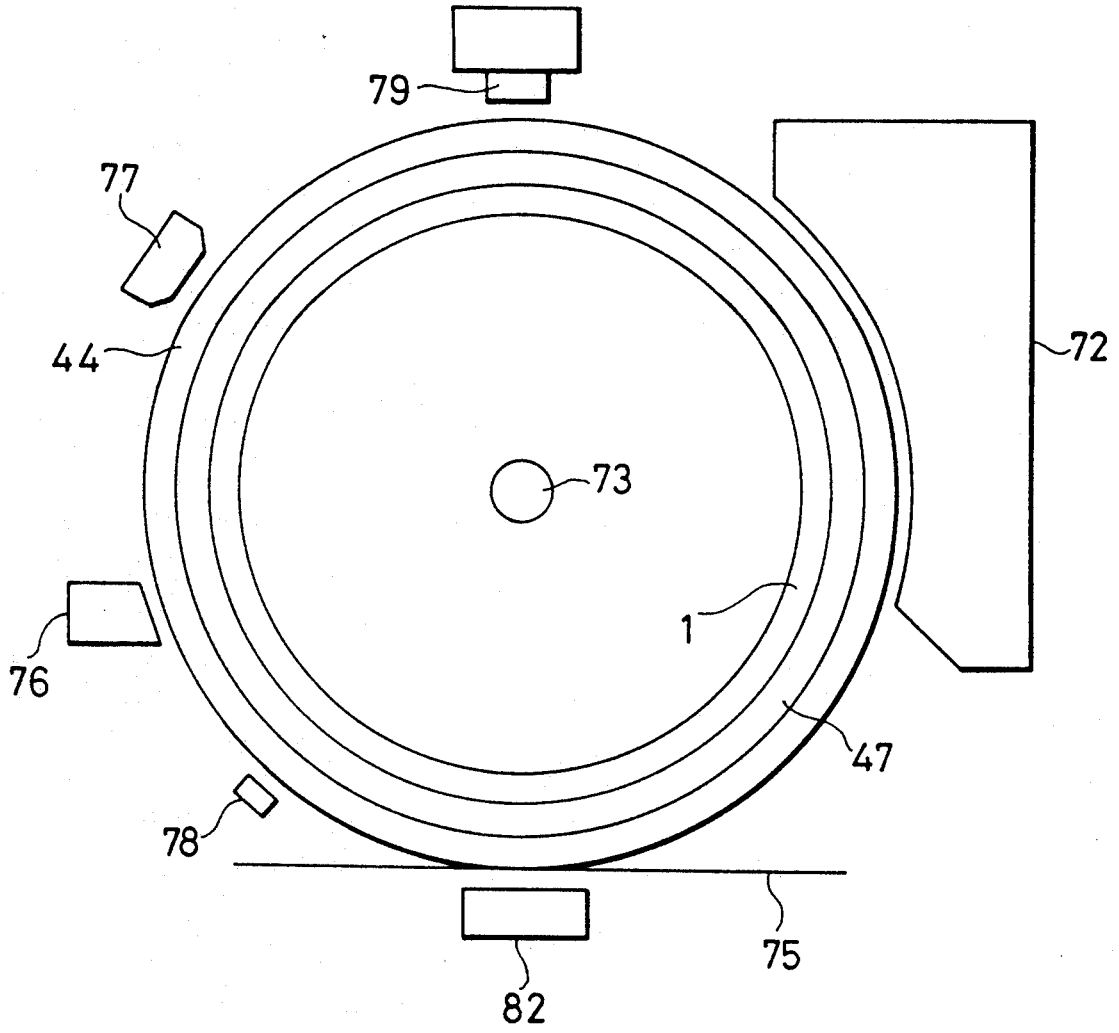

FIG. 6(B) is a partial enlarged view of FIG. 6(A).

The drum-shaped image-forming member 41 for electrophotography is composed of an organic photoconductive layer 47 provided on an aluminum substrate 1 and a protective layer 44 provided on the organic photoconductive layer 47.

The electrostatic photocopying machine 71 is composed of the drum-shaped image-forming member 41 capable of rotating around an axis of a shaft 73, an electrical charging means 77, for example a corona discharge means, a light image projecting means 79, a developing means 72, a transfer means 82, a fixing means 78, a cleaning means 76, a paper supplying roller 80, and a paper hoisting roller 81. A copying sheet 75 is to be moved between the transfer means 82 and the image-forming member 41 by means of the paper supplying roller 80 and the paper hoisting roller 81. The copying sheet 75 is subjected to electrophotocopying process in the electrostatic photocopying machine 71 and a copy is obtained. Since hollows on the organic photoconductive layer or on the protective layer are filled with an insulating material, image obtained on the copying sheet 75 is clear, and image flow, blur of images, white strips, voids, and the like are not found on the copy.

Since other modification and changes (varied to fit particular operating requirements and environments) will be apparent to those skilled in the art, the invention is not considered limited to the examples chosen for purposes of disclosure, and covers all changes and modifications which do not constitute departures from the true spirit and scope of this invention.

For example, image-forming member for electrophotography having other shapes such as a film shape may be manufactured.

What is claimed is:

1. An image-forming member for electrophotography comprising:

an organic photoconductive layer formed on a conductive substrate; and a protective layer formed on said organic photoconductive layer, wherein pinholes and cracks in said protective layer are filled with an organic photoconductive material so that an even surface is formed over said pinholes and cracks, said even surface being flush with a surface of said protective layer.

2. The image-forming member for electrophotography as claimed in claim 1 wherein a resistivity of said material is from $10_8$ to $10^{12}$ Ωcm.

3. The image-forming member for electrophotography as claimed in claim 1 wherein said organic photoconductive layer functions to generate electric charges therein by virtue of light and to transport the generated electric charges.

4. The image-forming member for electrophotography as claimed in claim 1 wherein said organic photoconductive layer comprises a charge carrier generation layer and a charge carrier transport layer.

5. The image-forming member for electrophotography as claimed in claim 1 wherein said conductive substrate has a cylindrical or plate shape.

6. The image-forming member for electrophotography as claimed in claim 1 wherein said conductive substrate is a conductor or an insulator having a conducting surface.

7. The image-forming member for electrophotography as claimed in claim 1 wherein a Vickers hardness of said protective layer is from 100 to 3000 kg/mm$^2$.

8. The image-forming member for electrophotography as claimed in claim 1 wherein said protective layer is selected from the group consisting of diamond like carbon layer, silicon nitride layer, silicon oxide layer, and silicon carbide layer.

9. The image-forming member for electrophotography as claimed in claim 1 wherein said material is a positive photoresist.

10. The image-forming member for electrophotography as claimed in claim 4 wherein said material is a material of said charge carrier transport layer.

11. A method for manufacturing an image-forming member for electrophotography comprising the steps of:

forming an organic photoconductive layer on a conductive substrate;

forming a protective layer on said organic photoconductive layer; and filling pinholes in said protective layer with an organic photoconductive material to form an even surface over said pinholes, said even surface being flush with a surface of said protective layer.

12. The method of claim 11 wherein a layer is formed on said protective layer by said filling step.

13. The method of claim 12 further comprising the step of planarizing a surface of the layer formed on said protective layer.

14. The method of claim 13 wherein said planarizing step is carried out by removing an upper portion of the layer formed on said protective layer.

15. The method of claim 13 wherein said planarizing step is carried out by removing an upper portion of the layer formed on said protective layer so that the planarized surface is flush with the surface of said protective layer.

16. The method of claim 11 wherein said filling step is carried out by rolling on said protective layer a roller coated with said material.

17. The method of claim 11 wherein said protective layer is coated with said material by said filling step and said material is removed by a squeegee in order to fill said hollows with said material.

18. The method of claim 11 wherein said organic photoconductive layer comprises a charge carrier generation layer and a charge carrier transport layer.

19. The method of claim 18 wherein said charge carrier transport layer is made of said material.

20. The method of claim 11 wherein said material has a resistivity of $10^8$ to $10^{12}$ Ωcm.

21. The method of claim 11 wherein said protective layer has a vickers hardness of 100 to 3000 kg/mm$^2$.

22. A method for manufacturing an image-forming member for electrophotography comprising the steps of:

forming a photoconductor comprising a conductive substrate, an organic photoconductive layer provided on said substrate, and a protective layer provided on said organic photoconductive layer;

fabricating a device for electrophotography from said photoconductor;

subjecting said photoconductor to electrophotography processing repeatedly;

detaching said photoconductor from said device; and filling hollows in said protective layer with a material.

23. The method of claim 22 wherein a layer is formed on said protective layer by said filling step.

24. The method of claim 23 further comprising the step of planarizing a surface of the layer formed on said protective layer.

25. The method of claim 24 wherein said planarizing step is carried out by removing an upper portion of the layer formed on said protective layer.

26. The method of claim 24 wherein said planarizing step is carried out by removing an upper portion of the layer formed on said protective layer so that the planarized surface is flush with the surface of said protective layer.

27. The method of claim 22 wherein said filling step is carried out by rolling on said protective layer a roller coated with said material.

28. The method of claim 22 wherein said protective layer is coated with said material by said filling step and said material is removed by a squeegee in order to fill said hollows with said material.

29. The method of claim 22 wherein said organic photoconductive layer comprises a charge carrier generation layer and a charge carrier transport layer.

30. The method of claim 29 wherein said charge carrier transport layer is made of said material.

31. The method of claim 22 wherein said material has a resistivity of $10^8$ to $10^{12}$ Ωcm.

32. The method of claim 22 wherein said protective layer has a Vickers hardness of 100 to 3000 kg/mm$^2$.

* * * * *